United States Patent [19]

Osborne

[11] 4,313,547

[45] Feb. 2, 1982

[54] PRODUCE CONTAINER

[75] Inventor: Edward L. Osborne, Kansas City, Kans.

[73] Assignee: Westvaco Corporation, New York, N.Y.

[21] Appl. No.: 162,250

[22] Filed: Jun. 23, 1980

[51] Int. Cl.[3] ..... B65D 5/36; B65D 5/56

[52] U.S. Cl. ..... 220/416; 220/441; 229/16 R; 229/33; 229/41 B

[58] Field of Search ..... 220/416, 441; 229/16 R, 229/23 R, 41 R, 41 B, 33, 36

[56] References Cited

U.S. PATENT DOCUMENTS

| | | | |
|---|---|---|---|
| 3,193,176 | 7/1965 | Gallickson | 229/33 X |
| 3,441,193 | 4/1969 | Castle | 229/33 |
| 3,635,451 | 1/1972 | Wagner | 229/37 R |
| 3,667,666 | 6/1972 | Pryor | 229/16 R |
| 3,670,949 | 6/1972 | Galanes | 229/41 B X |
| 3,727,824 | 4/1973 | Giebel et al. | 229/16 R |
| 3,902,651 | 9/1975 | Marshall | 229/3.1 |
| 4,221,294 | 9/1980 | Burgess | 229/33 X |

*Primary Examiner*—Allan N. Shoap

[57] ABSTRACT

A side loading produce container is disclosed which is folded into its final configuration from a single flat blank of corrugated paperboard or the like. The folding sequence produces a container having three-ply end walls, two-ply sided walls and an integral top and bottom. The container includes integral top-to-bottom corner posts at one side thereof and a combination tab and slot manufacturer's joint alignment feature.

6 Claims, 7 Drawing Figures

35
41
42
31
27
14
37
43
40
39
16
29
10
18
38

35
27
14
37
33
29
10
18
38

PRODUCE CONTAINER

BACKGROUND OF INVENTION

The present invention relates generally to produce containers and more particularly to hydrocooled produce containers. Hydrocooling is the practice of directly spraying a filled container with water in order to maintain the freshness of the products shipped in the container.

Wire bound wood crates have traditionally been used for shipping fresh produce and particularly for shipping produce that is hydrocooled before, during and after shipment. Unfortunately, wire bound wood crates are expensive to manufacture and maintain, and in order to justify the expense involved, they must be reused. Naturally, such reuse requires that the crates be returned empty so they can be refilled and this is an inconvenience because of the sheer bulk of the empty crates.

In view of these and other drawbacks with the use of wire bound crates, many attempts have been made in the past to convert the packers of produce to the use of corrugated paperboard containers. In general, most of these attempts have failed because of poor design and the inability of the corrugated paperboard to retain its strength and integrity under hydrocooling conditions. At least one method used in the past for protecting corrugated paperboard from the deteriorating effects of the hydrocooling process has been to seal the edges of the corrugations to prevent the entry of water. U.S. Pat. Nos. 3,635,451 and 3,902,651 each show methods for sealing the edges of corrugated paperboard and containers constructed from such paperboard. However, the present invention takes a different approach toward the same end result based on the design of the container and the means by which the container is filled.

SUMMARY OF INVENTION

The produce container of the present invention is cut and scored from a single blank of corrugated paperboard or the like that may, but not necessarily, be prepared from a wax impregnated corrugated paperboard material substantially as disclosed in U.S. Pat. No. 2,982,333. The blank is cut and scored to provided a double side wall construction with integral corner posts to add top-to-bottom stacking strength. Meanwhile, the end walls are of triple thick construction to provide stacking strength and hand hole support. The blank also includes a combination tab and slot arrangement for aligning the manufacturer's joint when the blank is stitched or otherwise formed into its container configuration.

The various panels are arranged on the blank such that the top, bottom and a first pair of end walls are aligned in the central portion thereof. A manufacturer's joint is foldably attached to one end wall and is secured to the bottom wall when the container is formed. Meanwhile, the upper and lower portions of the blank each contain a pair of side walls and a pair of end wall panels. The end wall panels on the lower portion of the blank include the manufacturer's joint alignment tab and slot, and the integral corner posts. After the manufacturer's joint is attached to the bottom panels as set forth above, the lower portion of the blank is folded to construct one side of the container. This folding sequence leaves the opposite side of the container open so the container can be filled prior to fabricating the second side thereof. Thus, the mode of construction fully disclosed in the specification and drawing hereof, including the use of water resistant paperboard, produces a container which is superior to those disclosed in the prior art and which is cheaper than the traditional wire bound crates. In addition, the container of the present invention is set up from its flat blank configuration with only the manufacturer's joint being secured, and without the need for additional staples, stitches or other fastening means. Hence the container of the present invention is particularly adapted for field use where no assembly apparatus is available. Furthermore, because the container can be collapsed into its flat condition after use, it is readily returned for reuse.

Accordingly, with these objects in view, the novel features of the present invention and the method of carrying it out will more fully appear from the following detailed description when read in connection with the accompanying drawing. It is to be understood, however, that the drawing is intended for illustration only since the scope of the invention is defined in the appended claims.

IN THE DRAWING

DETAILED DESCRIPTION

Figure 1:
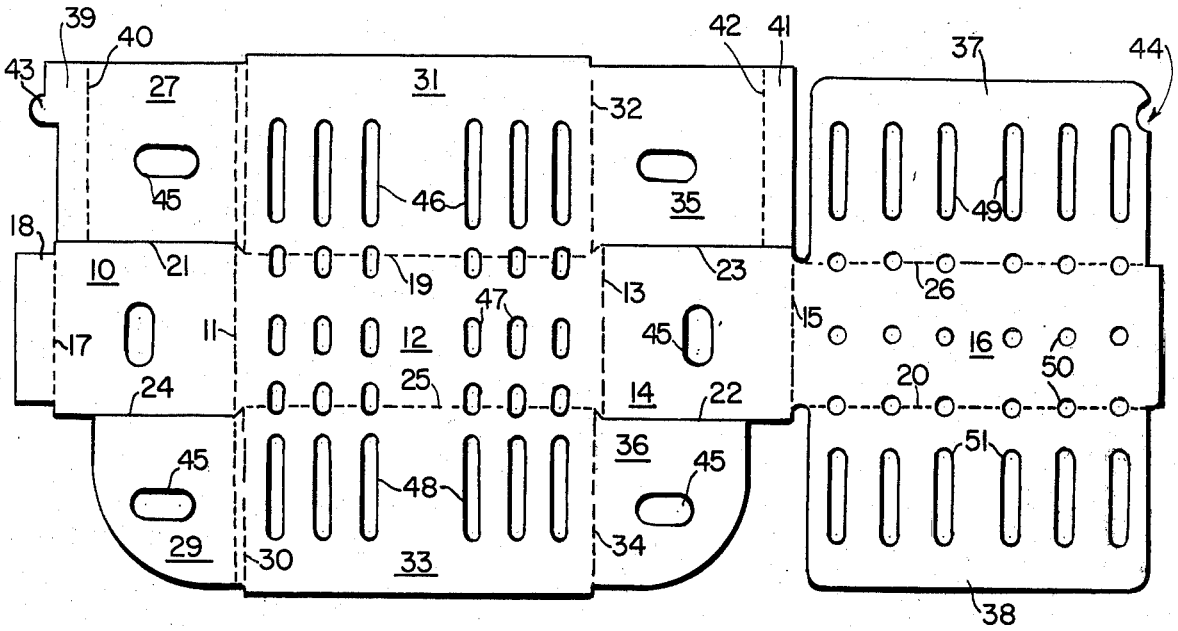
FIG. 1 is a plan view of a blank of material, preferably corrugated paperboard, from which the container of the present invention is constructed.

Referring now in more detail to the drawing, wherein like parts are indicated in each view by like reference numerals, FIG. 1 illustrates a substantially rectangularly shaped blank of corrugated paperboard that is cut and scored to provided the different flaps and panels necessary for forming the container. The blank comprises a central portion consisting of end wall panel 10, top panel 12, end wall panel 14 and bottom panel 16 separated from one another by the parallel spaced apart fold lines 11, 13 and 15. In addition, attached to end wall panel 10 along another fold line 17 is a closure flap 18 which forms the manufacturer's joint of the container. Each of the panels 10 and 14 ultimately form a first pair of opposed end walls for the container and for this purpose, each includes an integral handhole cut out 45. Meanwhile, the top panel 12 and bottom panel 16 are each applied with openings 47 and 50 useful for admitting and exiting water from the container during hydrocooling.

The upper portion of the blank consists of an end wall panel 27, a side wall panel 31, a second end wall panel 35 and a second side wall panel 37. End wall panel 27 is separated from end wall panel 10 along a cut line 21 and is foldably attached to side wall panel 31 by the spaced score lines 28. In addition, end wall panel 27 also has a corner post flap 39 foldably attached thereto along fold line 40 while the corner post flap 39 includes an integral manufacturer's joint alignment tab 43. Meanwhile, side wall panel 31 is foldably attached to the top wall panel 12 along score line 19, and at the opposite end to the end wall panel 35 along fold line 32. As in the case of end wall 27, the end wall panel 35 also includes an integral corner post flap 41 attached thereto along score line 42. The upper portion of the blank is completed by the second side wall panel 37 which is foldably attached to the bottom panel 16 along a score line 26 and which includes an integral manufacturer's joint alignment slot 44. The end walls 27 and 35 each include handhole cut outs 45 and the side walls 31,37 each include elongated openings 46 and 49 which admit water into the container to refresh the product during hydrocooling. The lower portion of the blank consists of an end wall panel 29, a side wall panel 33, a second end wall panel 36 and a second side wall panel 38. End wall panel 29 is connected to side wall panel 33 along a pair of spaced score lines 30 and is separated from end wall panel 10 along a cut line 24. Side wall panel 33 is foldably attached to the top panel 12 along a score line 25 and end wall panel 36 is foldably attached to the side wall panel 33 along score line 34 and is separated from the end wall panel 14 along a cut line 22. The lower portion of the blank is completed by the second side wall panel 38 which is foldably attached to the bottom panel 16 along a score line 20. As in the case of the upper portion of the blank, the end wall panels 29,36 are each applied with handhole cut outs 45 and the side wall panels 33,38 contain the elongated hydrocooling openings 48,51.

The manner in which the various panels are cut from the blank produces three pairs of end wall panels and two pairs of side wall panels. The end wall panels each include handhole cut outs which coincide with one another when the blank is folded and the side wall panels each include hydrocooling openings which also coincide when the container is formed.

Figure 2:
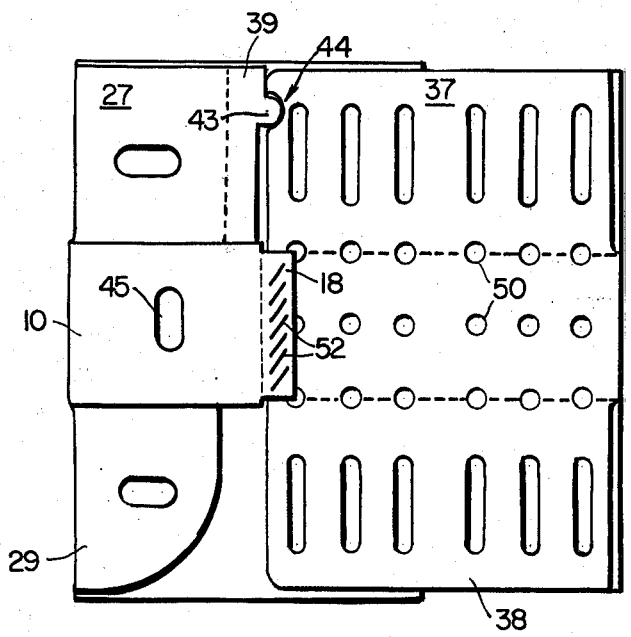
FIG. 2 shows the use of the manufacturer's joint alignment means for aligning and attaching the manufacturer's joint to the bottom panel.

FIG. 2 illustrates the first folding step for producing the container. Since the dimensions of the blank may be large, depending upon the product to be packaged, and because the folded blank can become awkward to fabricate, the end wall panel 27 and corner post 39 includes an integral manufacturer's joint alignment tab 43 which is arranged to fit within a manufacturer's joint alignment slot 44 integral with side wall 37. In this condition the manufacturer's joint 18 becomes properly aligned with the bottom panel 16 where it is stapled, stitched or otherwise secured as shown at 52. After this step, the blank may be shipped in its flattened condition for assembly at the point of use.

Figure 3:
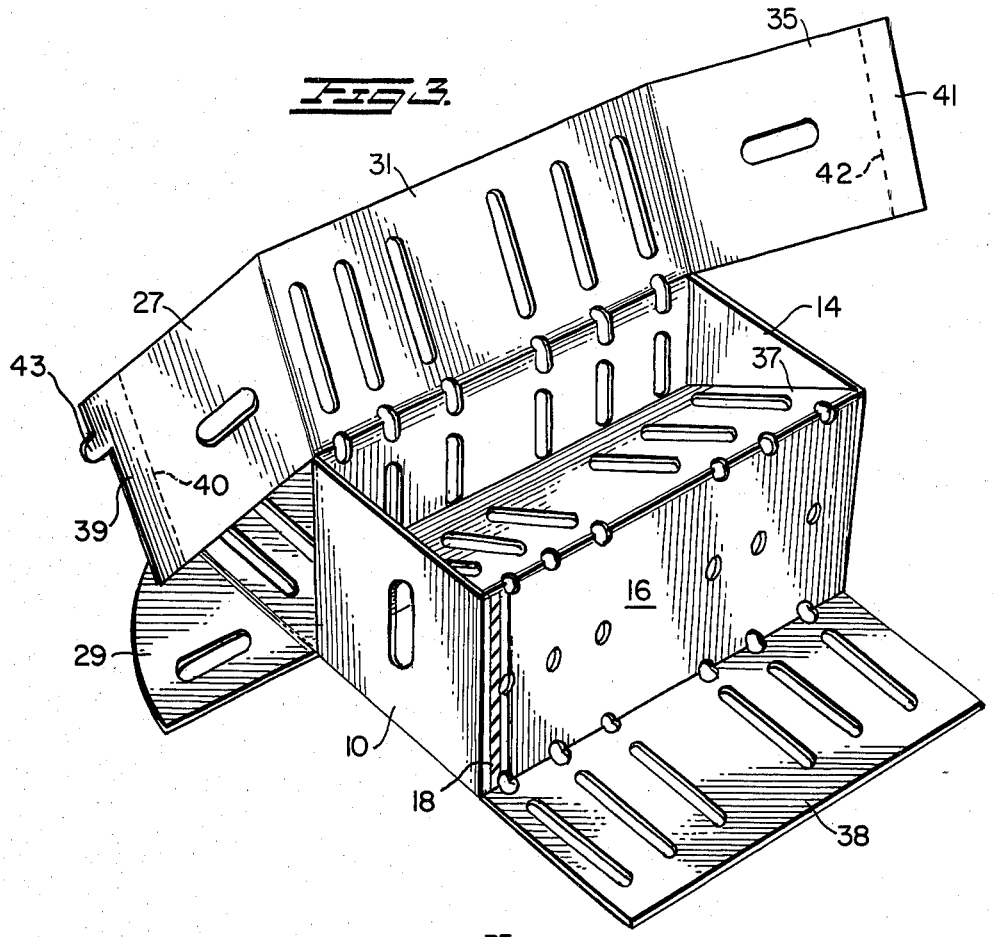
FIG. 3 shows in perspective a first step in the folding sequence for constructing one side of the container.
Figure 4:
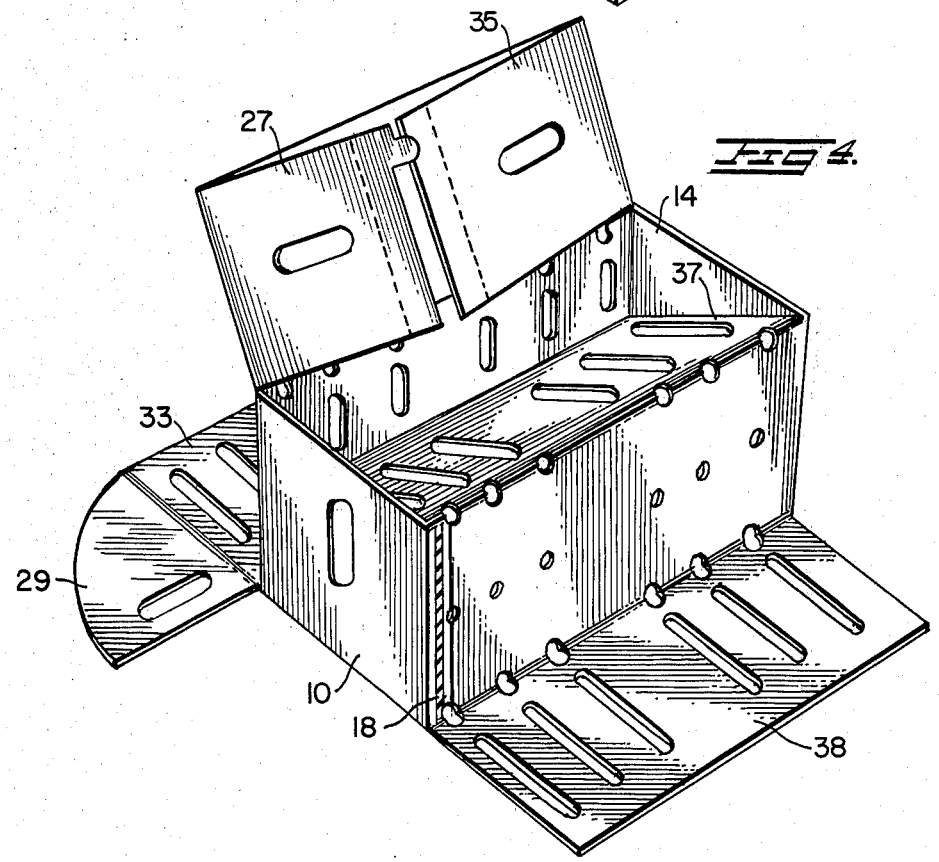
FIG. 4 shows in perspective a second step in the folding sequence for constructing one side of the container.
Figure 5:
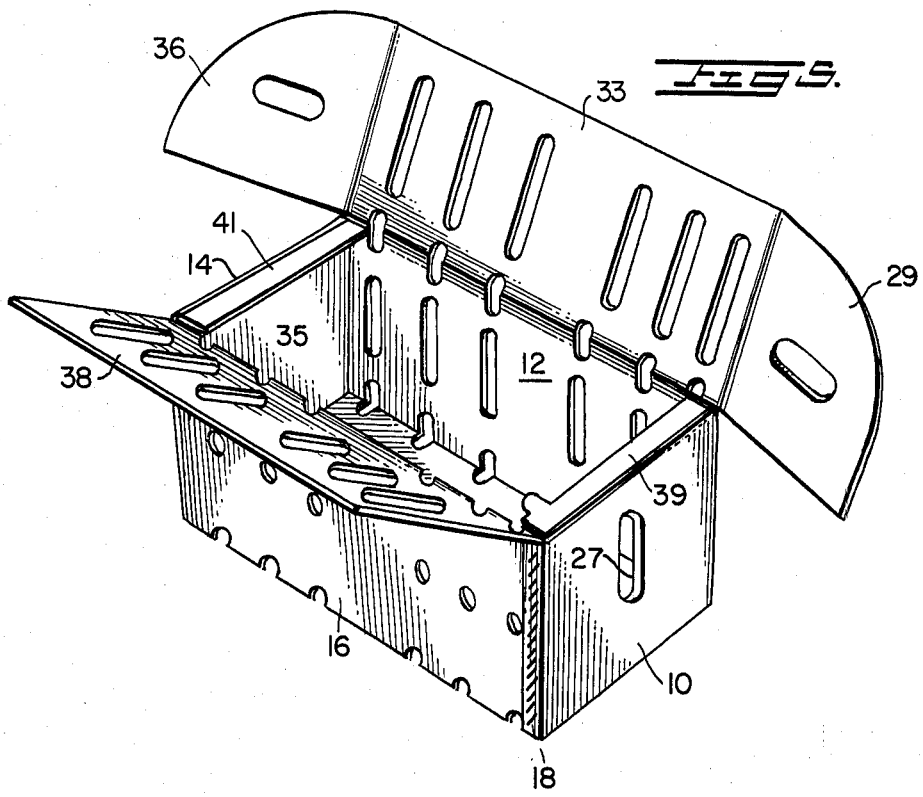
FIG. 5 shows in perspective the open second side of the container for filling.
Figure 6:
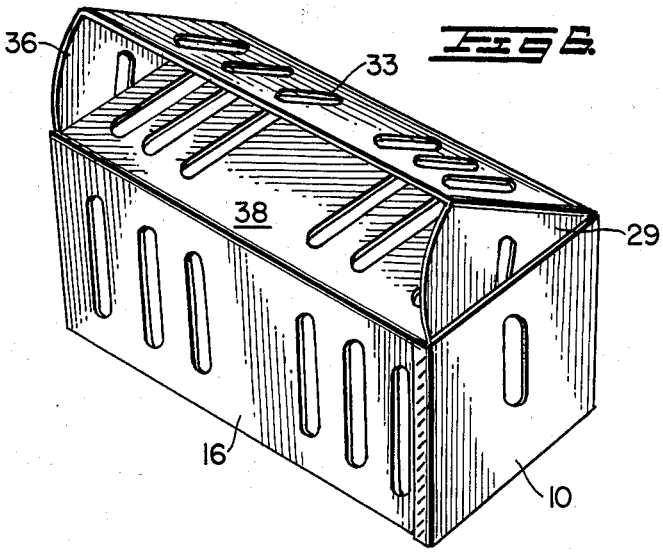
FIG. 6 shows in perspective the closing sequence for the second side of the container; and, FIG. 7 shows in perspective the closed and filled container.
Figure 7:
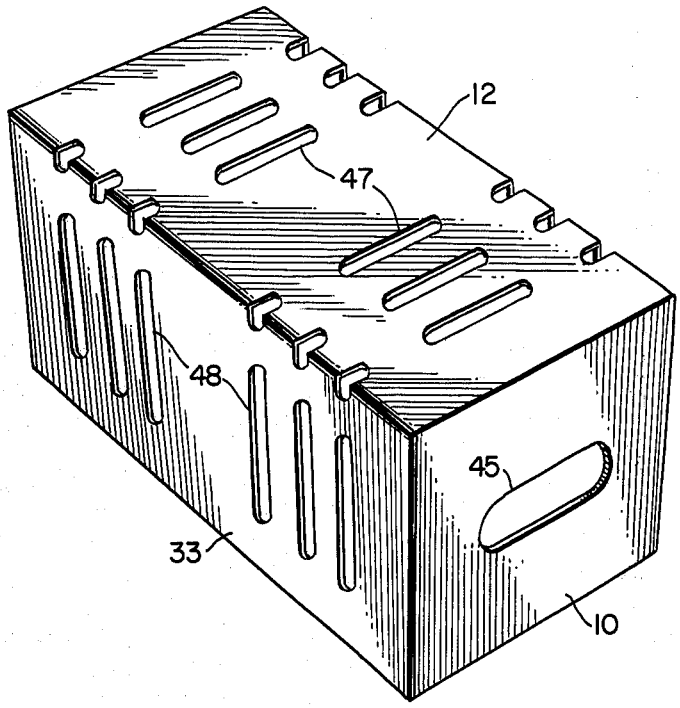

FIGS. 3 and 4 show the condition of the blank in the first stages of assembly. For this purpose, the blank is squared and turned on one side. In this condition, side wall panel 37 is folded inside and adjacent to the bottom panel 16. End wall panels 27 and 35 are folded over to overlap one another and the two end panels 27,35 and their attached side wall panel 31 are all folded inside the container. At this point, the container is turned over on its just formed side as shown in FIG. 5 where the two end wall panels 27 and 35 are folded upwardly to lie adjacent the first end wall panels 10 and 14. At the same time, the two corner post flaps 39 and 41 are folded into position and the side wall panel 37 is folded downwardly to lie on top of side wall 31. In this condition, the container is ready for loading through the open side wall. After loading, the container is closed as shown in FIG. 6. For this purpose, side wall 38 is folded over first and the end wall panels 29,36 are inserted between the previously folded end wall panels 10,27 and 14,35 before folding over the side wall panel 33. In this manner, a completed container is formed as shown in FIG. 7 with triple end walls, double side walls and integral top-to-bottom corner posts at one side of the container.

When the container blank is formed from moisture impervious paperboard as suggested hereinbefore, the hydrocooling process can be applied without catastrophic damage to the integrity of the container. The manner in which the container is folded presents a minimum number of edges to the water spray application thereby reducing the tendency of the paperboard to absorb moisture through edge wicking or the like. Moreover, because the container is formed from a paperboard blank that can be collapsed and returned for reuse, it offers an imminently practical replacement for the traditional wire bound wooden crates normally used.

It will be understood by those skilled in the art that although the specification and drawing describe only a single embodiment of the container, containers of varying shape and different cross sectional dimensions could readily be assembled in accordance with the principles of the invention. Therefore, the description set forth hereinbefore is for illustration only since the invention is limited only by the scope of the appended claims.

I claim:

1. A blank of corrugated paperboard or the like of substantially rectangular configuration that is cut and scored for folding into a produce container with an integral top comprising:

(a) a central portion divided by four parallel spaced apart transverse score lines into a manufacturer's joint, a top panel, a first pair of end panels and a bottom panel;

(b) an upper portion comprising a first pair of side wall panels foldably attached to the top and bottom panels of said central portion, one of said first side wall panels further including a second pair of end wall/tuck panels foldably attached thereto; and, (c) a lower portion comprising a second pair of side wall panels foldably attached to the top and bottom panels of said central portion, one of said second side wall panels further including a third pair of end wall panels foldably attached thereto, said third pair of end wall panels each including an integral corner post flap, and one of said corner post flaps including a manufacturer's joint alignment tab which cooperates with a manufacturer's joint alignment slot located in the edge of the other of said second pair of side wall panels.

2. A produce container folded from a single cut and scored blank of corrugated paperboard or the like comprising:

(a) a bottom panel, top panel and a first pair of end panels foldably attached together;

(b) a manufacturer's joint foldably attached to one of said first pair of end panels and attached to the free end of said bottom panel;

(c) a first pair of side wall panels foldably attached along one edge of said top and bottom panels;

(d) a second pair of side wall panels foldably attached along the opposite edge of said top and bottom panels;

(e) a second pair of end wall/tuck panels foldably attached to the opposite edges of one of said second pair of side wall panels;

(f) a third pair of end wall panels foldably attached to the opposite edges of one of said second pair of side wall panels to provide a final construction having three-ply end walls, two-ply side walls and an integral top and bottom, said third pair of end wall panels further including integral corner post flaps, one of said corner post flaps having an alignment means for aligning said blank before erecting said container.

3. The produce container of claim 2 wherein said alignment means includes a manufacturer's joint alignment tab on said one corner post flap which cooperates with a manufacturer's joint alignment slot located in the edge of one of said second pair of side wall panels.

4. The produce container of claim 3 wherein each of said first, second and third pair of end wall panels include handhole cut outs which become aligned at each end of the container in the final construction.

5. The produce container of claim 4 wherein each of the side, top and bottom panels of the container include drainage slots and cut outs to provide effective hydrocooling of the produce packaged in the container.

6. The produce container of claim 5 which is loaded and unloaded through the side wall which includes the integrally attached end wall/tuck panels.

* * * * *